United States Patent [19]

Braid, deceased

[11] Patent Number: 4,547,302

[45] Date of Patent: Oct. 15, 1985

[54] BORATE ESTERS AND LUBRICANT COMPOSITIONS CONTAINING SUCH ESTERS

[75] Inventor: Milton Braid, deceased, late of Haddonfield, N.J., by Gerassimos Frangatos, executor

[73] Assignee: Mobil Oil Corporation, New York, N.Y.

[21] Appl. No.: 528,011

[22] Filed: Aug. 31, 1983

[51] Int. Cl.[4] ..... C10M 1/30

[52] U.S. Cl. ..... 252/48.4; 252/49.6; 252/46.3; 252/402; 252/403; 260/462 R

[58] Field of Search ..... 252/48.4, 49.6, 46.3, 252/402, 403; 260/462 R

[56] References Cited

U.S. PATENT DOCUMENTS

| | | | |
|---|---|---|---|
| 3,224,971 | 12/1965 | Knowles et al. | 260/462 R |
| 3,356,707 | 12/1967 | Hinkamp et al. | 252/49.6 |
| 3,646,098 | 2/1972 | Cyba | 260/462 R |
| 4,392,973 | 7/1983 | Moore et al. | 252/49.6 |

*Primary Examiner*—Y. Harris-Smith

*Attorney, Agent, or Firm*—Alexander J. McKillop; Michael G. Gilman; Howard M. Flournoy

[57] ABSTRACT

The present invention relates to novel borate esters synthesized from 2,2'-thiobis(alkylphenols) and thiobis-(alkylnaphthols) which when incorporated into various hydrocarbyl lubricant compositions impart improved resistance to oxidation and concomitantly control the acidity and viscosity of such compositions.

37 Claims, No Drawings

BORATE ESTERS AND LUBRICANT COMPOSITIONS CONTAINING SUCH ESTERS

CROSS REFERENCE TO RELATED APPLICATION

This application is related to Ser. No. 523,524, filed Aug. 16, 1983 of the same inventive entity.

BACKGROUND OF THE INVENTION

1. Field of the Invention

The present invention relates to novel borate esters made from 2,2'-thiobis(alkylphenols) and thiobis(alkylnaphthols) and to various hydrocarbyl compositions, e.g., lubricants, which are subject to oxidative degradation, containing a minor amount of said borate esters, sufficient to impart antioxidant characteristics thereto. More particularly, the present invention is directed to the aforedescribed novel borate esters and lubricant compositions containing same. The lubricant compositions in accordance herewith include various hydrocarbyl oils of lubricating viscosity, including hydrocracked lubricating oils, and oils adapted for use as hydraulic oils, automotive oils, gear oils, transmission fluids and waxes, greases and other solid forms prepared therefrom.

2. Description of the Prior Art

The employment of borate esters as antioxidants in lubricants has been known in the prior art. However, a serious drawback which has restricted the utility of borate esters generally and aryl borate esters in particular in lubricants has been the susceptibility to hydrolysis of such esters with the concomitant liberation of oil-insoluble, abrasive boric acid and simultaneous loss of desirable boron-imparted properties to the lubricants. U.S. Pat. No. 3,356,707 discloses hydrolytically stable borate esters of hindered phenols. However, it has been now found that it is not essential to have a hindered phenol ester group in the compositions of the present invention to achieve hydrolytic stability. Nevertheless, borate esters of certain hindered phenols can be highly useful.

SUMMARY OF THE INVENTION

In accordance with the present invention, it has been found that the borate esters of 2,2'-thiobis(alkylphenols) and thiobis(alkylnaphthols) exhibit effective control of acidity and viscosity increase in various petroleum base stocks of lubricating viscosity. Moreover, in contrast to prior art borate esters which very rapidly show, in their infrared spectra, the presence of boric acid after only brief exposure to atmospheric moisture, the borate esters of the present invention show no boric acid liberation on exposure to water vapor. Although there may be a partial hydrolysis of the esters of the present invention when in use, to produce partial esters of boric acid, such partial esters remain oil soluble and continue to function in the desired manner, i.e. as oxidation stabilizers and as effective acidity and viscosity control agents. Although the specific reasons for the hydrolytic stability of the boron esters of the present invention have not been established, and although applicant does not wish to be bound by any theory, it is believed that formation of cyclic structures involving coordination of the sulfur atom of the thiobisphenol with boron contributes substantially to the resistance of such compounds to hydrolysis.

Furthermore, in accordance with the present development, novel additives are also provided which impart to compositions containing same improved resistance to oxidation and ancillary properties such as protection against wear due to their boron and sulfur content. These additives are environmentally acceptable, non-hazardous and metal-free. The reactants employed to produce the additives of the present invention are economical and the manufacturing process is relatively simple. Thus the benefits offered by employment of the additives of the present invention are manifold. Of particular significance, however, is their ability to improve the oxidation properties of oleaginous materials such as lubricating media which may comprise either a mineral oil or fractions thereof or a synthetic oil, or mixtures of mineral and synthetic oils, or a grease or other solid lubricant prepared therefrom. In general, mineral oils, both paraffinic, naphthenic and mixtures thereof, employed as the lubricant or grease vehicle, may be of any suitable lubricating viscosity range, as for example, from about 45 SSU at 100° F. to about 600 SSU at 100° F., and preferably, from about 50 to about 250 SSU at 100° F. These oils may have viscosity indexes ranging to about 100 or higher. Viscosity indexes from about 70 to about 95 are preferred. The average molecular weights of these oils may range from about 250 to about 800.

In instances where synthetic oils are desired in preference to mineral oils, or in combination therewith, various compounds of this type may ba successfully utilized. Typical synthetic vehicles include polyisobutylene, polybutenes, hydrogenated polyolefins, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxy phenol)ether, phenoxy phenylethers. It is to be understood, however, that the compositions contemplated herein can also contain other materials, for example, corrosion inhibitors, extreme pressure agents, viscosity index improvers, co-antioxidants, anti-wear agents and the like. These materials do not detract from the value of the compositions of this invention, but rather serve to impart their customary properties to the particular compositions into which they are incorporated.

The borate esters in accordance with the invention can be employed in any amount sufficient to impart the desired degree of protection against oxidative degradation. In many instances the additives can be employed in amounts up to about 10% by weight but preferably from about 0.01 to about 5% by weight and more preferably from about 0.1–0.5 to about 2% by weight of the total composition. As mentioned hereinabove, these additives can be used in conjunction with standard additive packages without hindering the ability of such additives to perform their intended functions.

DESCRIPTION OF SPECIFIC EMBODIMENTS

The specific method of preparing the novel additives in accordance with the present invention is based in part on the knowledge that a known prior art antioxidant additive for lubricants, namely the heterocycle boroxarophenanthrene, exhibits metal anti-fungue improvement in addition to its antioxidant characteristics. This led to the conceptual synthesis of an ester by reacting boron with a 2,2'-thiobis(alkylphenol) to provide a 5-member ring incorporating boron which was in view of the above expected to be resistant to hydrolysis and act as an effective antioxidant additive for lubricant compositions. Such compounds would have the following structural formula

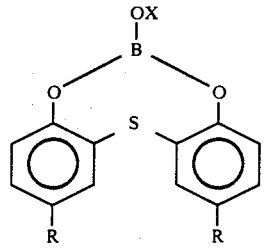

(I)

where the R's may be the same or different and are either H or an alkyl group having from 1 to about 36 carbon atoms and where x=H, alkyl, aryl, alkaryl, phenyl, thiophenyl, or hydroxy(alkylphenylthio) such as

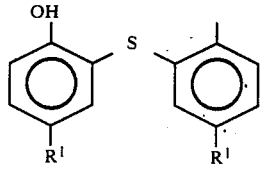

or mixtures thereof and wherein the $R^1$ groups are the same or different and are from about $C_1$ to $C_{30}$ alkyl. In a preferred embodiments R is $C_8H_{17}$ or is t-octyl. It was also postulated that the synthesis of a boron ester with a thiobis(alkylnaphthol) to provide an ester having comparable properties was also possible.

Generally the borating agent and the thiobisphenol or thiobisnaphthol are reacted in molar ratios of from about 2:1 to about 1:2. Preferred is 2:1 of thiobis-phenol or naphthol to borating agent. Any convenient method of borating may be used. Preferably, the borating agent is a boric acid compound such as 2,6-di-t-butyl-4-methyl phenyl boric acid.

Presented below is a method for the synthesis of a hindered phenol borate, a substituted 2,6-di-t-butylphenol borate.

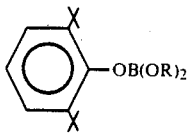

(II)

IIa—(R=n-butyl)
IIb—(R=H)

It is noted that t-butyl groups may be any $C_1$–$C_{30}$ alkyl group. Hydrolysis of IIa to IIb, which remains oil soluble, was very rapid, but further hydrolysis of IIb to release 2,6-di-t-butylphenol and boric acid was very slow. However, this kind of hydrolysis can be turned to advantage to effect the slow release during service of phenolic antioxidants from such novel hindered phenol borates.

EXAMPLE 1

Compound IIa, as illustrated above, was synthesized by the addition of 227 grams (1.0 mole) of tributyl borate to a 7-fold excess, 1442 grams (7.0 moles), of 2,6-di-t-butylphenol and heated at 250°–260° C. to produce a viscous liquid with distinctive infrared bands at 1350–1330, 1095 and 1075 (doublet) and 650 $cm^{-1}$. By this synthesis route, only the hindered phenol monoester IIa is produced despite the excess of the 2,6-di-t-butylphenol. Accordingly, exposure of this product to air on the infrared windows and evaporation of the liberated n-butanol produced a new spectrum with characteristic bands at 3240 ($B(OH)_2$), 1500-1420 (multiple, replacing the shrinking 1350–1330 bands) and 1205 $cm^{-1}$. These are quite different from boric acid's extremely broad hydroxyl, broad 1500–1400 and very broad 800 $cm^{-1}$ bands. The unassociated or hindered OH band of di-t-butylphenol at about 3675 $cm^{-1}$ was also absent, indicating that while there was hydrolysis of IIa, it was limited to the release of n-butanol.

EXAMPLE 2

Compound III, described below in general structural terms, was prepared by reacting 0.5 mole (175 grams) of IIa with 0.5 mole (221 grams) of 2,2'-thiobis-(4-t-octylphenol) at a reaction temperature of from about 200° C. to about 245° C. Slightly more than half the theoretical amount of n-butanol was obtained. There was evidence that little, if any, unreacted 2,2'-thiobis-(4-t-octylphenol) was present. The following is an elemental analysis of the product obtained: C, 74.31%, H, 9.98%, S, 5.8%, B, 1.6%.

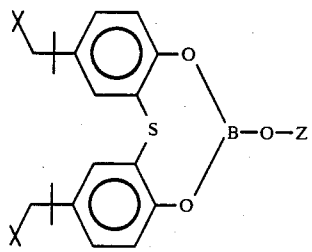

III

Z=2,6-di-t-butylphenol.

EXAMPLE 3

Two moles (440 grams) of nonyphenol and one mole (108 grams) of p-cresol were reacted with two moles (135 grams) of sulfur monochloride. The reaction was carried out in a stirred flask, under nitrogen. The sulfur monochloride was added dropwise to the stirred mixture of phenols over a period of two hours at 50°–60° C. The reactants were heated two additional hours at 60°–90° C. until evolution of HCl had ceased. The product was filtered to remove insolubles and consisted primarily of the intermediate sulfide described by the formula

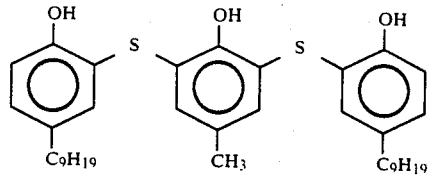

The intermediate (172 grams) was then heated with 2,6-di-t-butyl-4-methyl phenyl boric acid (60.3 grams, 0.22 mole) under nitrogen at 125° C. for five hours. Water was collected in a takeoff device. The product obtained weighed 196 grams of its infrared spectrum and analysis indicated the structure

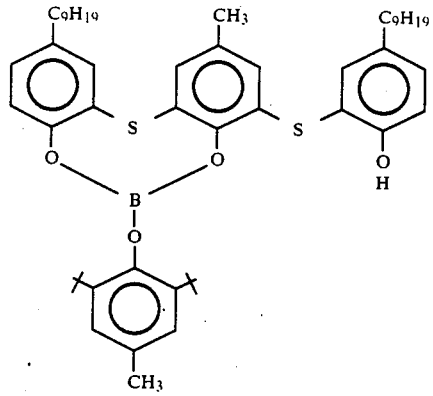

IV

EXAMPLE 4

80.0 grams (0.27 moles) of t-amylphenol sulfide and 39.1 grams (0.14 moles) of 2,6-di-t-butyl-4-methyl phenyl boric acid were heated in a distillation apparatus under nitrogen at 125° C. for one and one-half hours. A small amount of water was collected in a conventional take-off receiver. Vacuum was then applied and with heating and stirring at 100° C., a small amount of water and yellow distillate was removed from the reaction flask. The final product was a dark brown viscous oil weighing 114.2 grams. Infrared analysis indicated the structure to be

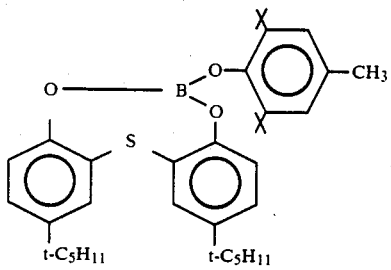

V

EXAMPLE 5

50.0 grams (0.07 moles) of 3,6-di-t-octyl-1,1-thiobis-2-naphthol and 10.2 grams (0.04 moles) of 2,6-di-t-butyl-4-methyl-phenyl boric acid were heated and stirred under toluene reflux (100 ml. toluene) for five hours. Water was removed in a side arm reflux take-off device. After removing solvent with vacuum at 120° C. the product was a dark, viscous oil weighing 56 grams. Infrared analysis indicated the structure to be

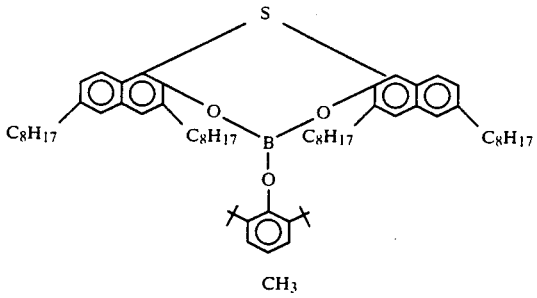

VI

The products as described herein when employed as additives in oils of lubricating viscosity and greases derived therefrom produce new lubricant compositions with improved resistance to oxidative deterioration, i.e. as oxidation stabilizers and as effective acidity control agents. It is to be understood that this invention is not limited by the specific exemplary compounds prepared. Any of the alkyl groups, that is $C_8H_{17}$, $C_9H_{19}$ or $CH_3$ groups may be demoninated simply as R, $R^1$ or $R^2$ wherein the R, $R^1$ or $R^2$ may be the same or different in the same compound and can be H or from about $C_1$ to about $C_{36}$ alkyl. Also, the positions of the alkyl groups attached to the aromatic rings may vary greatly.

EVALUATION OF PRODUCTS

The additive material hereinabove identified as IIIa was tested in a catalytic oxidation test for lubricants, using as the base medium a neutral solvent refined mineral base oil having a viscosity at 100° F. of 130 SUS. The test lubricant composition is subjected to a stream of air which is bubbled through the composition at a rate of 5 liters per hour at 325° F. for 40 hours. Present in the composition are metals commonly used as materials of engine construction, namely:

(a) 15.6 sq. in. of sand-blasted iron wire,
(b) 0.78 sq. in. of polished copper wire,
(c) 0.87 sq. in. of polished aluminum wire, and
(d) 0.167 sq. in. of polished lead surface.

Inhibitors for oil are rated on the basis of prevention of oil deterioration as measured by the increase in acid formation or neutralization number (ΔNN) and kinematic viscosity (ΔKV) occasioned by the oxidation. Compounds in accordance with this nvention tested for their oxidative stabilizing properties in accordance with the above Catalytic Oxidative Test proved highly effective oxidation stabilizers and/or inhibitors.

In assessing the results of this test, it will be understood that the more important consideration is the control of viscosity increase (ΔKV).

TABLE 1

B-10A Catalytic Oxidation Test: 325° F., 40 Hours

| Additive | Wt. % CONC. | ΔNN | ΔKV, % |
|---|---|---|---|
| None | — | 17.0 | 334 |
| Example 2 | 2.0 | 0.14 | — |
| | 1.0 | 1.2 | 17 |
| | 0.5 | 4.1 | 43 |
| Example 3 | 1.0 | 0.3 | 6 |
| | 0.5 | 0.7 | 7 |
| | 0.25 | 1.7 | 10 |
| Example 4 | 2.0 | 0.1 | 19 |
| | 1.0 | 0.3 | 6 |
| | 0.5 | 0.6 | 6 |

TABLE 1-continued

| B-10A Catalytic Oxidation Test: 325° F., 40 Hours | | | |
|---|---|---|---|
| Additive | Wt. % CONC. | ΔNN | ΔKV, % |
| Example 5 | 2.0 | 2.9 | 20 |
| | 1.0 | 1.4 | 13 |
| | 0.5 | 7.7 | 34 |

*A solvent refined paraffinic base oil

Certain modifications of the invention will become apparent to those skilled in the art. Accordingly, the illustrated details disclosed are not to be construed as imposing limitations on the invention.

What is claimed is:

1. A compound having the following general structure

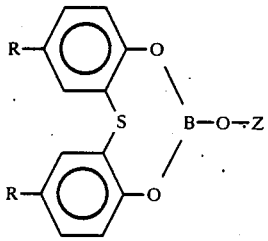

where Z=2,6-di-t-butylphenol and where R is H or $C_1$ to $C_{36}$ alkyl.

2. The compound of claim 1 where each R=t-octyl.

3. A compound having the following general structure

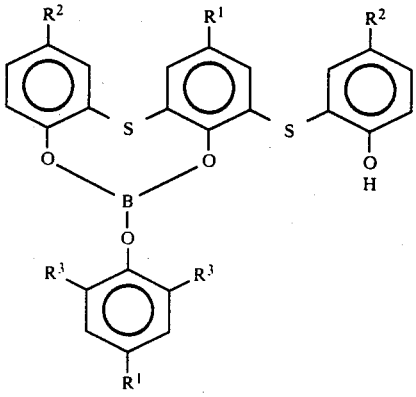

where $R^1$, $R^2$ and $R^3$ may be the same or different and are H or alkyl of from about $C_1$ to $C_{36}$.

4. The compound of claim 3 wherein each $R^1=CH_3$ and each $R^2=C_9H_{19}$ and each $R^3$=t-butyl.

5. A compound having the following general structure

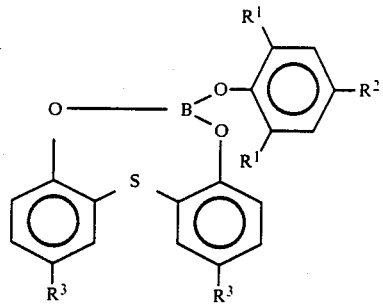

where each $R^1$, $R^2$ and $R^3$ are H or alkyl from $C_1$–$C_{36}$ and may be the same or different.

6. The compound of claim 5 where each $R^1$=t-butyl, $R^2=C_3$ and each $R^3$=t-$C_5H_{11}$.

7. A compound having the following general structure

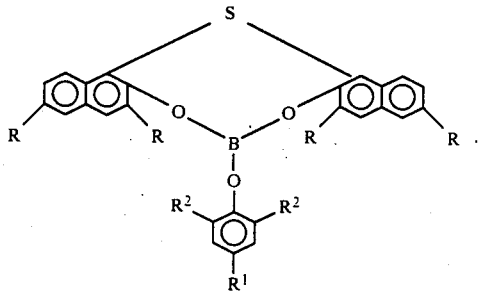

where each R, $R^1$ and $R^2$ are alkyl from $C_1$–$C_{36}$ and may be the same or different.

8. The compound of claim 7 where $R=C_8H_{17}$ and $R^1=CH_3$ and $R^2$=t-butyl.

9. A compound having the following general structure where $R^1$ and R may be the same or different and are H or alkyl of 1 to about 36 carbon atoms or H.

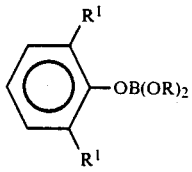

10. The compound of claim 9 where R=H and each $R^1$=t-butyl.

11. The compound of claim 9 where R=n-butyl and each $R^1$=t-butyl.

12. A lubricant composition comprising a major amount of an oil of lubricating viscosity and a minor effective amount for stabilizing said composition against oxidative degradation and controlling acidity thereof, of a borate ester as defined in claim 1.

13. A lubricant composition comprising a major amount of an oil of lubricating viscosity and a minor effective amount for stabilizing said composition against oxidative degradation and controlling acidity thereof, of a borate ester as defined in claim 2.

14. A lubricant composition comprising a minor amount of an oil of lubricating viscosity and a minor effective amount for stabilizing said composition against oxidative degradation and controlling acidity thereof, of a borate ester as defined in claim 3.

15. A lubricant composition comprising a major amount of an oil of lubricating viscosity and a minor effective amount for stabilizing said composition against oxidative degradation and controlling acidity thereof, of a borate ester as defined in claim 4.

16. A lubricant composition comprising a major amount of an oil of lubricating viscosity and a minor effective amount for stabilizing said composition against oxidative degradation and controlling acidity thereof, of a borate ester as defined in claim 5.

17. A lubricant composition comprising a major amount of an oil of lubricating viscosity and a minor effective amount for stabilizing said composition against oxidative degradation and controlling acidity thereof, of a borate ester as defined in claim 6.

18. A lubricant composition comprising a major amount of an oil of lubricating viscosity and a minor effective amount for stabilizing said composition against oxidative degradation and controlling acidity thereof, of a borate ester as defined in claim 7.

19. A lubricant composition comprising a major amount of an oil of lubricating viscosity and a minor effective amount for stabilizing said composition against oxidative degradation and controlling acidity thereof, of a borate ester as defined in claim 8.

20. A lubricant composition comprising a major amount of an oil of lubricating viscosity and a minor effective amount for stabilizing said composition against oxidative degradation and controlling acidity thereof, of a borate ester as defined in claim 10.

21. A lubricant composition comprising a major amount of an oil of lubricating viscosity and a minor effective amount for stabilizing said composition against oxidative degradation and controlling acidity thereof, of a borate ester as defined in claim 11.

22. The lubricant composition defined in claim 13 wherein the additive compound is present in an amount from about 0.01 to about 5% by weight.

23. The lubricant composition defined in claim 15 wherein the additive compound is present in an amount from about 0.01 to about 5% by weight.

24. The lubricant composition defined in claim 17 wherein the additive compound is present in an amount from about 0.01 to about 5% by weight.

25. The lubricant composition defined in claim 19 wherein the additive compound is present in an amount from about 0.01 to about 5% by weight.

26. The lubricant composition defined in claim 13 wherein said lubricant is selected from mineral oils or fractions thereof, synthetic oils or mixtures of mineral and synthetic oils.

27. The lubricant composition defined in claim 15 wherein said lubricant is selected from mineral oils or fractions thereof, synthetic oils or mixtures of mineral and synthetic oils.

28. The lubricant composition defined in claim 17 wherein said lubricant is selected from mineral oils or fractions thereof, synthetic oils or mixtures of mineral and synthetic oils.

29. The lubricant composition defined in claim 19 wherein said lubricant is selected from mineral oils or fractions thereof synthetic oils or mixtures of mineral and synthetic oils.

30. The lubricant composition of claim 25 wherein the lubricant is a mineral oil.

31. The lubricant composition of claim 26 wherein the lubricant is a mineral oil.

32. The lubricant composition of claim 27 wherein the lubricant is a mineral oil.

33. The lubricant composition of claim 28 wherein the lubricant is a mineral oil.

34. The lubricant composition of claim 25 wherein the lubricant is a mineral oil.

35. The lubricant composition of claim 26 wherein the lubricant is a mineral oil.

36. The lubricant composition of claim 27 wherein the lubricant is a mineral oil.

37. The lubricant composition of claim 28 wherein the lubricant is a mineral oil.

* * * * *

UNITED STATES PATENT AND TRADEMARK OFFICE

CERTIFICATE OF CORRECTION

PATENT NO. : 4,547,302

DATED : October 15, 1985

INVENTOR(S) : Milton Braid

It is certified that error appears in the above-identified patent and that said Letters Patent is hereby corrected as shown below:

Column 2, line 67, "anti-fungue" should read --anti-fatigue--.

Column 6, line 49, "nvention" should read --invention--.

Column 8, line 18, "$R^2=C_3$" should read --$R^2=CH_3$--.

Column 8, line 66, "minor" should read --major--.

Column 10, line 24, after "thereof" please add a comma --,--.

Signed and Sealed this

Tenth Day of June 1986

[SEAL]

*Attest:*

DONALD J. QUIGG

*Attesting Officer*

*Commissioner of Patents and Trademarks*